US007284519B1

(12) United States Patent
Best et al.

(10) Patent No.: US 7,284,519 B1
(45) Date of Patent: Oct. 23, 2007

(54) DEVICE FOR HYDRAULIC LASH ADJUSTMENT

(75) Inventors: Richard Best, Garden City, MI (US); Florin Bugescu, Canton, MI (US); Debora Manther, Royal Oak, MI (US)

(73) Assignee: Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/626,984

(22) Filed: Jan. 25, 2007

Related U.S. Application Data

(60) Provisional application No. 60/783,643, filed on Mar. 17, 2006.

(51) Int. Cl.
*F01L 1/14* (2006.01)

(52) U.S. Cl. ..... 123/90.48; 123/90.52; 123/90.16

(58) Field of Classification Search ..... 123/90.48, 123/90.15, 90.16, 90.49, 90.52, 90.55
See application file for complete search history.

(56) References Cited

U.S. PATENT DOCUMENTS

2001/0004886 A1* 6/2001 Brothers ..... 123/90.48

* cited by examiner

*Primary Examiner*—Zelalem Eshete
(74) *Attorney, Agent, or Firm*—Volpe and Koenig, P.C.

(57) ABSTRACT

A device (1) for the hydraulic lash adjustment for several identically acting gas-exchange valves per cylinder of a valve train of an internal combustion engine is provided, the device (1)including a common housing (2) with directly adjacent pressure pistons (3) provided corresponding to the number of identically acting gas-exchange valves. Each pressure piston (3) moves relative to the housing in an axial direction in a separate guide (4) in the housing (2), and also has a support (6) for an at least indirect contact with the corresponding gas-exchange valve on a distal end (5) away from the housing, and a non-return valve (8) in the region of a housing bottom (7) wherein a separate high-pressure chamber (9) is associated with each pressure piston (3) in which the non-return valve (8) opens. The high-pressure chamber (9) extends axially between the bottom (7) of the pressure piston (3) and a base (10) of the housing (2), and the pressure pistons (3) arranged in the common housing (2) have a common reservoir.

2 Claims, 1 Drawing Sheet

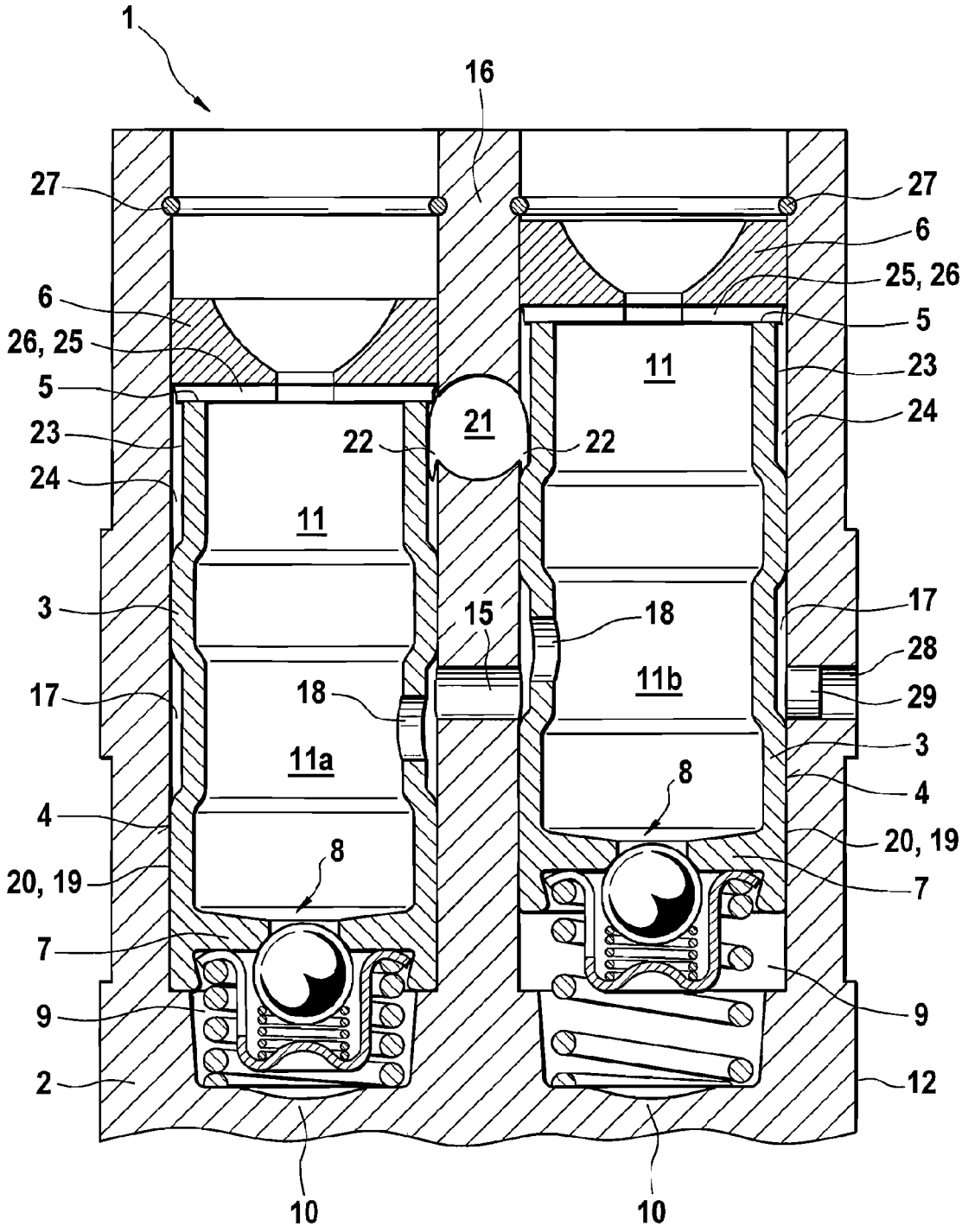
1
16
27
27
6
25, 26
6
5
26, 25
11
23
5
21
24
23
22
22
24
11
3
15
18
17
28
17
18
11b
29
3
11a
8
4
4
20, 19
8
20, 19
7
7
9
9
2
12
10
10

DEVICE FOR HYDRAULIC LASH ADJUSTMENT

CROSS-REFERENCE TO RELATED APPLICATIONS

This application claims the benefit of U.S. Application No. 60/783,643, filed Mar. 17, 2006, which is incorporated by reference herein as if fully set forth.

FIELD OF THE INVENTION

The invention relates to a device for hydraulic lash adjustment for several identically acting gas-exchange valves per cylinder of a valve train of an internal combustion engine, wherein each gas-exchange valve communicates at least indirectly with a pressure piston that can move in a guide and wherein a separate high-pressure chamber, into which a non-return valve opens is arranged on the pressure piston, is allocated to each pressure piston.

BACKGROUND

Such devices for simultaneously applying force on several identically acting gas-exchange valves are generally known to those skilled in the art and do not have to be explained in more detail at this point. These devices are also used partially for shutting off or switching valve lifts.

In the devices noted above, a separate reservoir and high-pressure chamber is allocated to each pressure piston. The constant goal of further reducing the oscillating valve train masses, but also reducing installation space problems, etc., leads to the continuous miniaturization of such devices. Thus, the amount of hydraulic medium that can accumulate in the reservoir of the pressure piston necessarily decreases. In other words, the ratio of volumes of the reservoir to the high-pressure chamber becomes worse.

If the internal combustion engine with the valve train according to this type is shut down, then the reservoirs can empty. Here, the pressure pistons that are shut down at the point of valve lift are most at risk. When the internal combustion engine is turned on again and sufficient pressure has not yet built up in the hydraulic medium, not enough hydraulic medium is available for proper lash adjustment (for example, to move the element away from the blocked position) and thus rattling noises are generated.

SUMMARY

Therefore, the objective of the invention is to create a device of the type named above, in which the cited disadvantages are overcome with simple means.

According to the invention, this objective is met by the new features of claim 1. Accordingly, the adjacent pressure pistons are separated from each other in a common housing only by a longitudinal web, wherein the pressure pistons communicate with separate high-pressure chambers, but their hydraulic medium is drawn from a common reservoir.

Here, it is especially preferable when the common reservoir is realized by "merging" the reservoirs unique to the pressure pistons, wherein a hydraulic connection of these sub-reservoirs is realized by an axial, relatively low-lying transverse channel in the longitudinal web.

Thus, the level of hydraulic medium is constantly adjusted from the pressure piston with the sub-reservoir having the higher level into the pressure piston with the sub-reservoir having the correspondingly lower level. At this point, it is clear that such an adjustment of hydraulic medium can be realized only up to a bottom edge of the transverse channel.

The invention preferably relates to a device, in which two pressure pistons lie directly next to each other in a common housing. A number of pressure pistons $\geqq 3$ is also conceivable, however. In the three identically acting gas-exchange valves currently included in the state of the art per cylinder, a 2-1 grouping can also be realized.

The lower the transverse channel, the better its potential for level adjustment. As further stated according to the claim, however, a leakage gap for the hydraulic medium from the respective high-pressure chambers is to be formed axially between this channel and the base of the pressure piston on the side of the housing and also radially between the guide and an outer casing of the pressure piston. Here, a certain minimal height of this leakage gap is necessary for proper forcing of the hydraulic medium out of the high-pressure chamber indirectly back into the sub-reservoirs during a high-pressure phase (cam lift).

According to a preferred embodiment of the invention, each pressure piston is to be provided with a corresponding annular groove, which has at least one passage into the corresponding sub-reservoir, at the height of the transverse channel. Thus, a simple solution for hydraulic medium overflow is provided, without the pressure piston having to be locked in rotation. If necessary, the corresponding guide can also be provided with an annular groove in the region of the transverse channel and, in contrast, the pressure piston can be equipped with a smooth surface.

A simple possibility for a supply line of the hydraulic medium to the device is described in another subordinate claim. Here, the supply line can run axially above the transverse channel in the transverse web. Thus the hydraulic medium can reach the sub-reservoirs via lateral outlets in the transverse web, annular grooves in the region of reduced-diameter sections of the pressure pistons, and corresponding radial channels in the end region of the pressure pistons. It is also conceivable, however, to supply each pressure piston with hydraulic medium separately.

In a refinement of the invention, it is provided to apply the radial channel in the respective support on one end of the pressure piston, with this support advantageously being constructed separately.

For unimpaired hydraulic medium overflow, it can be especially advantageous when several star-shaped radial channels are provided in the support. If necessary, crown-shaped openings are also conceivable in the region at the end of the pressure piston.

According to another embodiment of the invention, the housing has corresponding height stop means axially above the ends of the pressure pistons as path limiters and/or captive devices for the pressure pistons in the seating of the housing. These stop means can be constructed, for example, as known safety rings, wire rings, pins, projections, etc.

A simple possibility for machining the transverse channel is the subject matter of another subordinate claim. Accordingly, the transverse channel is drilled laterally through the housing before final assembly of the device. The external bore lying diametrically opposite the transverse channel on the guide is preferably closed with sealing means, such as a stopper, a screw, or the like.

The device for hydraulic lash adjustment according to the invention for several identically acting gas-exchange valves per cylinder can be used for a wide variety of valve train types, such as OHV, OHC, or DOHC. Thus, the device can be constructed directly as a roller tappet or flat tappet (tappet push rod contact) and can be provided, in the case of the construction as a roller tappet, underneath the base of the housing with at least one roller for a cam contact. A use as a cup-shaped tappet for applying force directly to several identically acting gas-exchange valves is also conceivable, however. Use of the device as a support for a group of finger levers or valve lifters, however, is also provided.

BRIEF DESCRIPTION OF THE DRAWING

The invention is explained in more detail with reference to the drawing. The single FIGURE shows a device for hydraulic lash adjustment in longitudinal section.

DETAILED DESCRIPTION OF THE PREFERRED EMBODIMENTS

The Figure shows a device 1 for hydraulic lash adjustment for several identically acting gas-exchange valves per cylinder of a valve train of an internal combustion engine. The device 1 is constructed according to the drawing for applying force to exactly two identically acting gas-exchange valves. It is composed of a pot-shaped housing 2, with two directly adjacent guides 4 (bores). A pressure piston 3 of known construction sits in each guide 4 so that it can move with its outer casing 19. Each pressure piston 3 has a separate support 6 for applying force indirectly to a gas-exchange valve in the region of its one end 5. In the construction disclosed in the figure, the supports 6 are used as contacts for tappet push rods, which, on the other end, act on valve lifters, which finally communicate with the gas-exchange valves in a known manner.

In the region of its housing-side base 7, each of the pressure pistons 3 has a non-return valve 8. This valve opens in the direction towards a high-pressure chamber 9 lying underneath. The high-pressure chamber 9 extends axially between the respective base 7 of the pressure piston 3 and a base 10 of the housing 2. Here, the high-pressure chambers 9 are not interconnected hydraulically.

Each of the pressure pistons 3 seals a sub-reservoir 11*a*, 11*b* for hydraulic medium in the direction towards its end 5 axially above the corresponding base 7. This hydraulic medium is supplied in a longitudinal web 16 between the guides 4 via a geodetically high supply line 21. Here, the supply line 21 intersects each guide 4 with an outlet 22. The respective pressure piston 3 has a corresponding reduced diameter section 23 at the height of the supply line 21, so that an annular chamber 24 is formed between the receptacle 4 and the outer casing 19 of the corresponding pressure piston 4.

Thus, the hydraulic medium can be led from the supply line 21 via the annular chamber 24 and at least one radial channel 25 formed in the region of the end 5 into the corresponding sub-reservoir 11*a*, 11*b*. According to the construction disclosed in the Figure, each support 6 has at least one radial channel 25 in the region of its support 26 facing the end 5.

The essential feature of the invention is that the sub-reservoirs 11*a*, 11*b* are interconnected hydraulically on a geodetically relatively low-lying level and thus in the end a common reservoir 11 is formed. For illustrating the connection, the transverse channel 15 is provided in the longitudinal web 16. The corresponding pressure pistons 3 each have an annular groove 17, in which at least one passage 18 is present in the corresponding sub-reservoir 11*a*, at the height of the transverse channel 15. If necessary, the corresponding guide 4 can also be provided with such an annular groove, so that the pressure piston 3 can then be illustrated with a smooth surface in this region.

The transverse channel 15 can be realized, for example, through drilling. Here, the drill or another suitable tool is set on the section on the outer casing 12 of the housing 2 lying diametrically opposite the transverse channel 15 on the guide 4. The functionless bore 28 can then be sealed by sealing means 29, such as a stopper, or the like.

Now if the hydraulic medium levels in the sub-reservoirs 11*a*, 11*b* come to lie at different heights, then level equalization is performed via the overflow 15. The side with the lower amount of hydraulic medium is thus "filled up," so that both sides have an adequate amount for proper, rattle-free lash adjustment. A bottom edge of the transverse bore 15 limits this adjustment process.

| List of reference symbols | |
|---|---|
| 1 | Device |
| 2 | Housing |
| 3 | Pressure piston |
| 4 | Guide |
| 5 | End |
| 6 | Support |
| 7 | Bottom |
| 8 | Non-return valve |
| 9 | High-pressure chamber |
| 10 | Base |
| 11 | Reservoir |
| 11a | Sub-reservoir |
| 11b | Sub-reservoir |
| 12 | Outer casing |
| 13, 14 | not assigned |
| 15 | Transverse channel |
| 16 | Longitudinal web |
| 17 | Annular groove |
| 18 | Passage |
| 19 | Outer casing |
| 20 | Leakage gap |
| 21 | Supply line |
| 22 | Outlet |
| 23 | Reduced-diameter section |
| 24 | Annular chamber |
| 25 | Radial channel |
| 26 | Support |
| 27 | Height stop means |
| 28 | Bore |
| 29 | Sealing means |

The invention claimed is:

1. A hydraulic lash adjusting device for a plurality of identically operating gas exchange valves per cylinder of a valve train of an internal combustion engine, said device comprising a common housing in which pressure pistons corresponding in number to the identically operating gas exchange valves are arranged in close proximity to one another, each of said pressure pistons extending in a separate guide of the housing for relative axial displacement thereto and possessing on a housing-distal end, a support for an at least indirect contact with the corresponding gas exchange valve and further including a one-way valve in a region of a bottom of the housing, and a separate high pressure chamber into which the one-way valve opens being associated with each of the pressure pistons, the high pressure chamber extending axially between the bottom of the housing for the pressure pistons and a base of the housing, and the pressure pistons arranged in the common housing include a common reservoir.

2. A device of claim 1, wherein each of the pressure pistons encloses a partial reservoir for hydraulic medium axially between ends thereof and the bottoms thereof, said partial reservoirs being in hydraulic communication with one another through at least one cross-channel for forming the common reservoir, the cross-channel being arranged in a longitudinal web that is situated between the two adjacent guides and separates the guides from each other.

* * * * *